United States Patent [19]

Barrett

[11] Patent Number: 4,700,481

[45] Date of Patent: Oct. 20, 1987

[54] CUTTER HEAD ASSEMBLY FOR POWER PLANER

[75] Inventor: Michael E. Barrett, Easley, S.C.

[73] Assignee: The Singer Company, Stamford, Conn.

[21] Appl. No.: 866,534

[22] Filed: May 23, 1986

[51] Int. Cl.[4] ..... B26D 1/00

[52] U.S. Cl. ..... 30/475; 83/700

[58] Field of Search ..... 30/475, 487, 489, 492, 30/62–65, 335, 169; 83/700, 640

[56] References Cited

U.S. PATENT DOCUMENTS 2,771,105 11/1956 Metoff .
3,600,816 8/1971 Watanabe .
3,673,907 7/1972 Watanabe .
3,732,611 5/1973 Watanabe .
4,066,111 1/1978 Klebe, Jr. .
4,347,882 9/1982 Bachmann .
4,370,908 2/1983 De Alto et al. ..... 83/700

*Primary Examiner*—Frederick R. Schmidt
*Assistant Examiner*—Maurina Rachuba
*Attorney, Agent, or Firm*—David L. Davis

[57] ABSTRACT

A cutter head assembly for a power planer in which cutting blades are arranged on an arbor in engagement with eccentric heads of blade locating elements journaled in the arbor and in which clamping plates for securing the blades in adjusted position constrain the blade locating elements on the arbor.

3 Claims, 5 Drawing Figures

CUTTER HEAD ASSEMBLY FOR POWER PLANER

BACKGROUND OF THE INVENTION

1. Field of the Invention

This invention relates to power planers, and more particularly, to a multiple blade cutter head assembly for a power planer with improved facility for adjusting and securing the cutting blades in predetermined position on the cutter head.

2. Objects of the Invention

It is an object of this invention to provide a particularly cost effective cutter head assembly for a power planer in which the multiple blades of the cutter head can be accurately adjusted to predetermined position quickly and easily. It is also an object of this invention to provide a cutter head assembly in which the means for securing the blades in selected position of adjustment also serve to constrain the blade adjusting means on the cutter head against accidental displacement therefrom during operation of the planer under power.

SUMMARY OF THE INVENTION

The above and additional objects and advantages of this invention are attained by the provision of eccentric blade locators rotatable within recesses in the cutter head arbor and engageable with slots in the cutter blade to effect radial blade adjustment with respect to the cutter arbor. The eccentric locators are constrained in the arbor recesses and blade slots by overlying blade clamping plates through which small access apertures are provided to permit eccentric adjustment when the blade clamp is slightly loosened.

DESCRIPTION OF THE DRAWINGS

With the above and additional objects and advantages in view as will hereinafter appear, this invention will be described with reference to a preferred embodiment illustrated in the accompanying drawings in which.

DESCRIPTION OF THE PREFERRED EMBODIMENT

Figure 1:
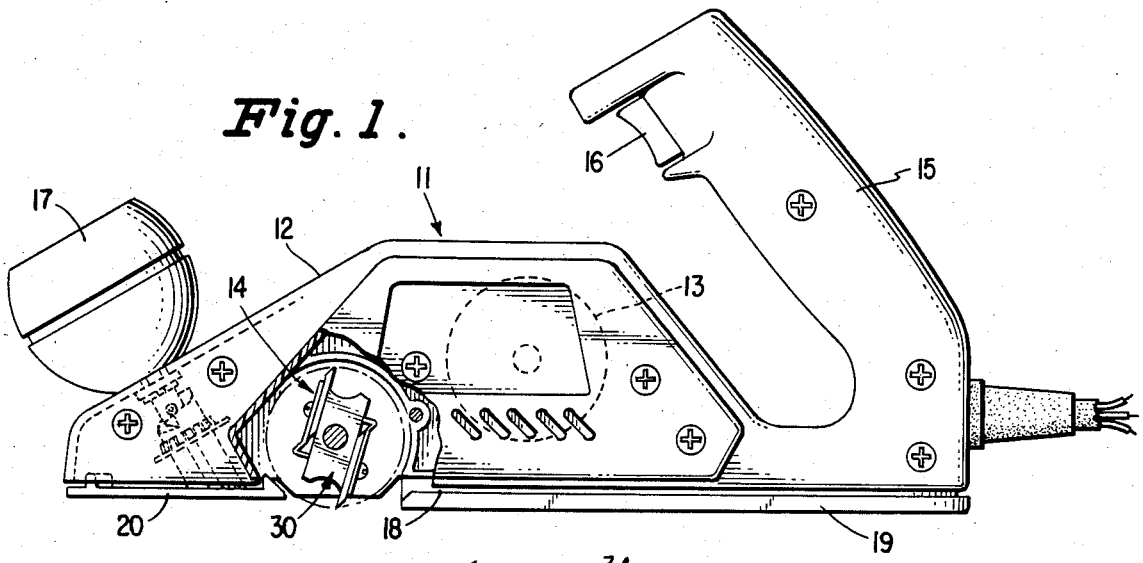
FIG. 1 is a side elevational view of a power planer with portions of the planer frame broken away to expose the cutter head assembly of this invention applied thereto.

Referring particularly to FIG. 1 of the drawings, a power planer indicated generally at 11 is illustrated having a frame 12 housing a motor 13 adapted to rotate a cutter head assembly in accordance with this invention and indicated generally at 14. The planer frame 12 includes a handle 15 with a power switch 16 controlling the motor 13, and a knob 17 on the frame 12 which serves both as a supporting handle for manipulating the tool as well as an operator influenced control element for adjusting depth of cut of the planer.

Beneath the planer frame 12 and rearwardly of the cutter head assembly 14 is secured a platen 18 of which the flat undersurface 19 is adapted to contact and slide along the finished cut on a work piece. It is essential, therefore, that the cutter head assembly be capable of ready and effective adjustment so as to cut precisely in the plane defined by the platen undersurface 19. By rotating the knob 17, vertical adjustment of an infeed shoe 20 above the plane of the platen underside 19 may be effected so that work initially directed to the cutter at a level above that of the plane of the platen underside will be planed by the cutter head assembly to a depth equal to the distance above the plane of the platen underside 19 to which the infeed shoe 20 is adjusted.

Figure 2:
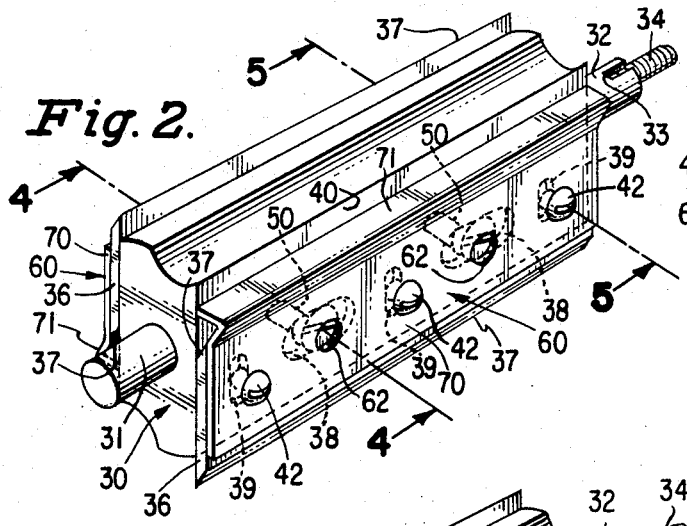
FIG. 2 is a perspective view of the cutting head assembly shown in FIG. 1.

Referring to FIG. 2, an assembled cutter head 14 embodying a preferred form of this invention is illustrated. The cutter head comprises an arbor 30 with supporting trunions 31 and 32, one at each side on which the arbor is adapted to be supported for rotation in bearings (not shown) in the planer frame 12. The trunion 32 may be formed with a keyway 33 and a threaded free extremity 34 or any similar configuration in order to accommodate a belt pulley, gear, or other motion transmitting connection (not shown) to the motor 13.

The cutter head illustrated in the accompanying drawings accommodates in diametrically opposed relation to each other, a pair of cutting blades 36—36. Since each of the cutting blades is mounted, adjusted and secured to the arbor 30 in the same manner, a detailed description of one will suffice. It will be understood that the arbor may be arranged to accommodate any reasonable number of such blades in evenly spaced relation about the arbor.

Figure 3:
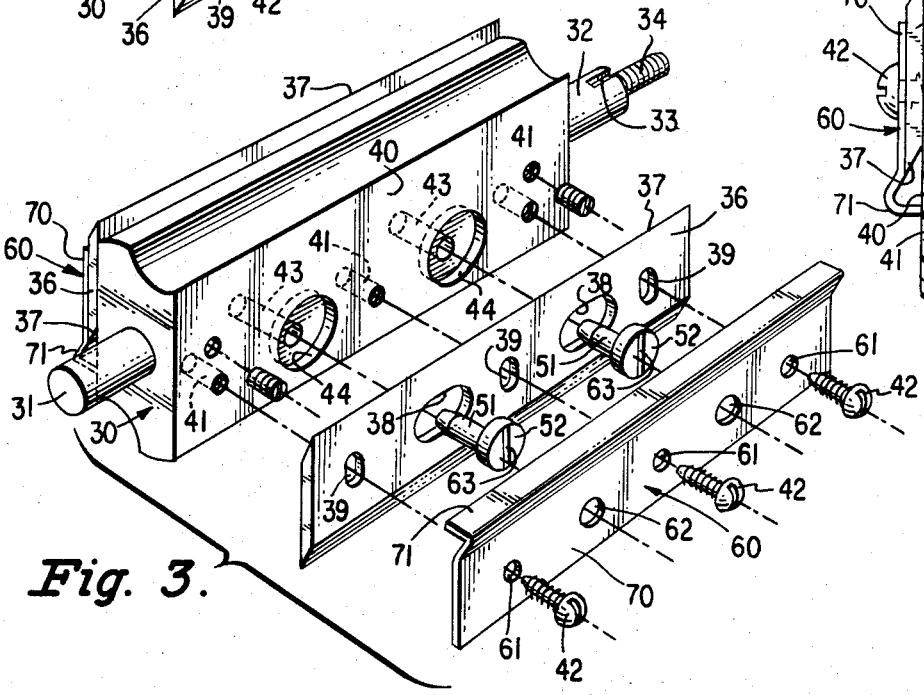
FIG. 3 is an exploded perspective view of the arbor, one cutting blade, associated blade adjusting locators, and blade clamp of the cutting head assembly shown in FIG. 2.

Each blade 36, as best shown in FIG. 3, comprises a substantially flat plate formed at each side with a beveled cutting edge 37. So that the blade may be reversed and each of the cutting edges 37 used selectively thus to double life of each blade, surfaces between the cutting edges 37 are preferably formed symetrical end for end as well as symetrical about a centerline equidistant from each of the cutting edges.

The surfaces formed within each blade include two lengthwise elongated adjustment slots 38 and three laterally elongate fastening accommodating slots 39.

The arbor 30 is formed with a flat radially extending surface 40 against which the blade 36 is placed. The arbor surface 40 is formed with three tapped holes 41 each to accommodate a headed screw 42 passing each through one of the laterally elongated holes 39 in the blade to secure the blade with limited capacity for radial adjustment to the arbor.

Figure 4:
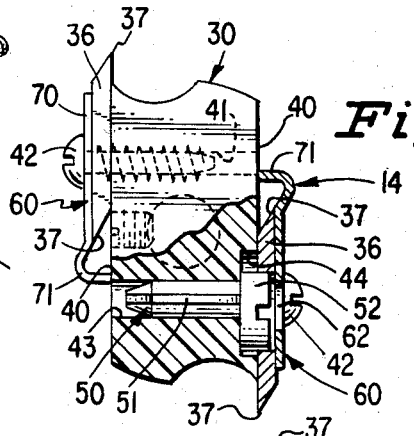
FIG. 4 is a cross sectional view taken substantially along line 4—4 of FIG. 2.
Figure 5:
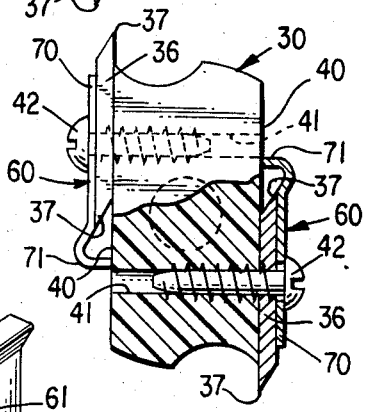
FIG. 5 is a cross sectional view taken substantially along line 5—5 of FIG. 2.

Between each of the tapped holes 41 the arbor 30 is formed with a plain cylindrical transverse bore 43, each joined adjacent the arbor surface 40 with an enlarged counterbore 44. Rotatable in each of the cavities formed by a bore 43 and counterbore 44 is a blade locating element indicated generally at 50, each of which includes a cylindrical pin 51 snuggly fitting within the bore 43, and an eccentric head 52 integral with the pin 51. As shown in FIG. 4, the thickness of the eccentric head 52 exceeds the depth of the counterbore 44 so that the eccentric head protrudes into an ajustment slot 38 in the cutter blade. Preferably the eccentric head is of a diameter snuggly fitting within the adjustment slot 38 so that when the locators 50 are rotated, the blade will be adjusted radially of the arbor 30.

A blade clamping plate 60 is arranged at the opposite side of the blade from the arbor 30 and formed with apertures 61 accommodating the fastening screws 42. Opposite each of the adjustment slots 38 in the blade, the clamping plate 60 is formed with a small access aperture 62 smaller than the eccentric head 52 of the locating element and preferably aligned with the central axis of the locator element pin 51 in the assembled relation of parts. Each access aperture 62 exposes a tool accommodating socket, such as a screwdriver slot 63 or an Allen wrench socket formed in the locating element but, since the apertures 62 are smaller than the eccentric locating elements heads, the clamping plate overlies and blocks egress of the locator elements from the bores 43 and counterbores 44 in the arbor 30. Each clamping plate 60 is formed with a plain flat outer edge 70 arranged against the blade 36 adjacent to the exposed effective cutting edge 37 of the blade. Along the opposite edge of the clamping plate 60 a flange 71 is bent inwardly at right angles to the clamping plate and extending from the clamping plate a distance slightly greater than the thickness of the blade 36. Before the fastening screws 42 are tightened, therefore, the clamping plate 60 will make contact with the blade 36 only along the flat outer edge 70 and the flange 71 will contact the arbor surface 40. When the fastening screws 42 are tightened, the clamping plate will be distored into substantial parallelism against the cutting blade 36 but with the greatest pressure being applied against the blade by the outer edge 70 of the clamping plate thus to provide a particularly secure clamping of the blade to the arbor.

In order to adjust the cutting blade 36 to travel in a path such that the cutting edge 37 moves tangent to and cuts in the plane defined by the platen undersurface 19, the screws 42 are loosened so that the blade is only lightly held in place on the arbor and then the locating elements are adjusted to bring the blade to the desired position of adjustment. Any known gauge for indicating blade exposure may be employed or any flat surface on which the platen undersurface 19 can be placed may be used as a gauge, the blade 36 being radially adjusted until it brushes lightly against the flat gauging surface. In this adjusted position of the blade 36, the fastening screws 42 are tightened readying the planer for operation under power to cut work precisely in the plane defined by the underside 19 of the platen 18.

As described above, this invention provides a planer cutting head assembly with provision for blade adjustment in a very simple and effective manner, which is capable of exceedingly cost effective manufacture.

Having set forth the nature of this invention, what is claimed herein is:

1. A cutter head assembly for a power planer comprising:

an arbor including bearing means for rotatably supporting said arbor on an axis in a power planer;

said arbor formed with a flat blade accommodating surface;

a flat cutting blade arranged flush against said blade accommodating surface on said arbor;

a sharpened cutting edge formed along one side of said blade;

said arbor formed on said flat blade accommodating surface with spaced cavities each including a smooth cylindrical bore transverse to the blade accommodating surface and an enlarged counterbore adjacent said blade accommodating surface;

blade locating elements arranged one in each of said arbor cavities and each including a cylindrical pin rotatable in said bore and a head eccentric to said cylindrical pin extending through and protruding out of said counter bore;

said cutting blade being formed with adjustment slots each embracing the eccentric head of one of said blade locating elements, said adjustment slots each being elongated in a direction parallel to said sharpened cutting edge of the blade, whereby rotation of said blade locating elements influences adjustment of said blade cutting edge radially of said arbor axis; and means for clamping said blade to said arbor in selected position of adjustment of said blade cutting edge.

2. A cutter head assembly for a power planer as set forth in claim 1 in which said means for clamping said blade to said arbor inclues a clamping plate overlying said blade at the oposite side thereof from said arbor;

fastening elements securing said clamping plate and said blade to said arbor; and means on said clamping plate overlying said adjustment slots in said blade when said clamping plate is secured by said fastening elements to block egress of said locating elements from said arbor cavities.

3. A cutter head assembly for a power planer as set forth in claim 2 in which said means on said clamping plate overlying said adjustment slots in said blade is formed with access openings each smaller than the eccentric heads of said locating elements, the eccentric head of each of said locating elements being formed with a tool accommodating irregularity engageable through one of the access openings in said clamping plate.

* * * * *